US009914612B1

(12) United States Patent
Hashimoto

(10) Patent No.: US 9,914,612 B1
(45) Date of Patent: Mar. 13, 2018

(54) POST-PROCESSING APPARATUS AND CONTROL METHOD

(71) Applicants: KABUSHIKI KAISHA TOSHIBA, Tokyo (JP); TOSHIBA TEC KABUSHIKI KAISHA, Tokyo (JP)

(72) Inventor: Yoshihisa Hashimoto, Gotemba Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/642,227

(22) Filed: Jul. 5, 2017

(30) Foreign Application Priority Data

Dec. 9, 2016 (JP) ..... 2016-239881

(51) Int. Cl.

| | |
|---|---|
| ***B65H 29/38*** | (2006.01) |
| ***B65H 43/02*** | (2006.01) |
| ***B65H 37/04*** | (2006.01) |
| *B65H 31/30* | (2006.01) |

(52) U.S. Cl.
CPC ..... *B65H 29/38* (2013.01); *B65H 37/04* (2013.01); *B65H 43/02* (2013.01); *B65H 31/3081* (2013.01); *B65H 2301/42266* (2013.01); *B65H 2301/5161* (2013.01); *B65H 2511/528* (2013.01); *B65H 2801/06* (2013.01)

(58) Field of Classification Search
CPC ..... B65H 43/02; B65H 43/06; B65H 29/38; B65H 31/3054; B65H 31/3081; B65H 2511/528; B65H 37/04; B65H 2301/5161
See application file for complete search history.

(56) References Cited

U.S. PATENT DOCUMENTS

| | | | | |
|---|---|---|---|---|
| 6,601,846 | B2 * | 8/2003 | Saito | B65H 31/34 270/58.12 |
| 7,984,900 | B2 * | 7/2011 | Terao | B65H 31/3081 270/58.08 |
| 9,725,272 | B2 * | 8/2017 | Kimura | B65H 31/3045 |
| 2002/0050677 | A1 * | 5/2002 | Sato | B65H 37/04 270/58.08 |
| 2002/0050681 | A1 * | 5/2002 | Hosaka | B27F 7/17 271/207 |
| 2014/0241737 | A1 * | 8/2014 | Shirasaka | G03G 15/6552 399/20 |
| 2017/0212462 | A1 * | 7/2017 | Hashimoto | G03G 15/6529 |

FOREIGN PATENT DOCUMENTS

JP 2016-133793 A 7/2016

* cited by examiner

*Primary Examiner* — Jeremy R Severson
(74) *Attorney, Agent, or Firm* — Patterson & Sheridan, LLP

(57) ABSTRACT

A post-processing apparatus for an image forming apparatus includes a processing tray on which a sheet bundle is placed for discharging onto a discharge tray, a detector configured to detect presence or absence of the sheet bundle on the processing tray, and a controller. The controller is configured to control driving of the processing tray to discharge the sheet bundle onto the discharge tray and to determine whether or not to output an error if a detection result of the detector after the processing tray has been driven to discharge the sheet bundle onto the discharge tray indicates presence of the sheet bundle. The controller outputs the error if the sheet bundle is not a last sheet bundle of a post-processing job and does not output the error if the sheet bundle is the last sheet bundle of the post-processing job.

18 Claims, 7 Drawing Sheets

POST-PROCESSING APPARATUS AND CONTROL METHOD

CROSS-REFERENCE TO RELATED APPLICATION

This application is based upon and claims the benefit of priority from. Japanese Patent Application No. 2016-239881, filed Dec. 9, 2016, the entire contents of which are incorporated herein by reference.

FIELD

Embodiments described herein relate generally to a post-processing apparatus and a control method.

BACKGROUND

A post-processing apparatus that performs post-processing, such as binding by a stapler on sheets discharged from an image forming apparatus, is known. For example, the post-processing apparatus stacks sheets on a processing tray, corrects displacement of the sheets in a lateral direction and a longitudinal direction, staples the sheets with a stapler, or the like, and then discharges the stapled sheet bundle to a stacking tray. In the post-processing apparatus, for example, a user may take out the sheet bundle while the sheet bundle is in the middle of being discharged to the stacking tray. In such a case, in the post-processing apparatus of the related art, when the user takes out the sheet bundle, if the sheet bundle comes in contact with a sensor, it is mistakenly determined that the sheet bundle is jammed, thereby resulting in an error.

DETAILED DESCRIPTION

Embodiments provide a post-processing apparatus capable of reducing unintentional determination of jamming of a sheet bundle and a control method thereof.

In general, according to one embodiment, a post-processing apparatus for an image forming apparatus includes a processing tray on which a sheet bundle is placed for discharging onto a discharge tray, a detector configured to detect presence or absence of the sheet bundle on the processing tray, and a controller. The controller is configured to control driving of the processing tray to discharge the sheet bundle onto the discharge tray and to determine whether or not to output an error if a detection result of the detector after the processing tray has been driven to discharge the sheet bundle onto the discharge tray indicates presence of the sheet bundle. The controller outputs the error if the sheet bundle is not a last sheet bundle of a post-processing job and does not output the error if the sheet bundle is the last sheet bundle of the post-processing job.

Hereinafter, a post-processing apparatus of an embodiment will be described with reference to the drawings.

Figure 1:
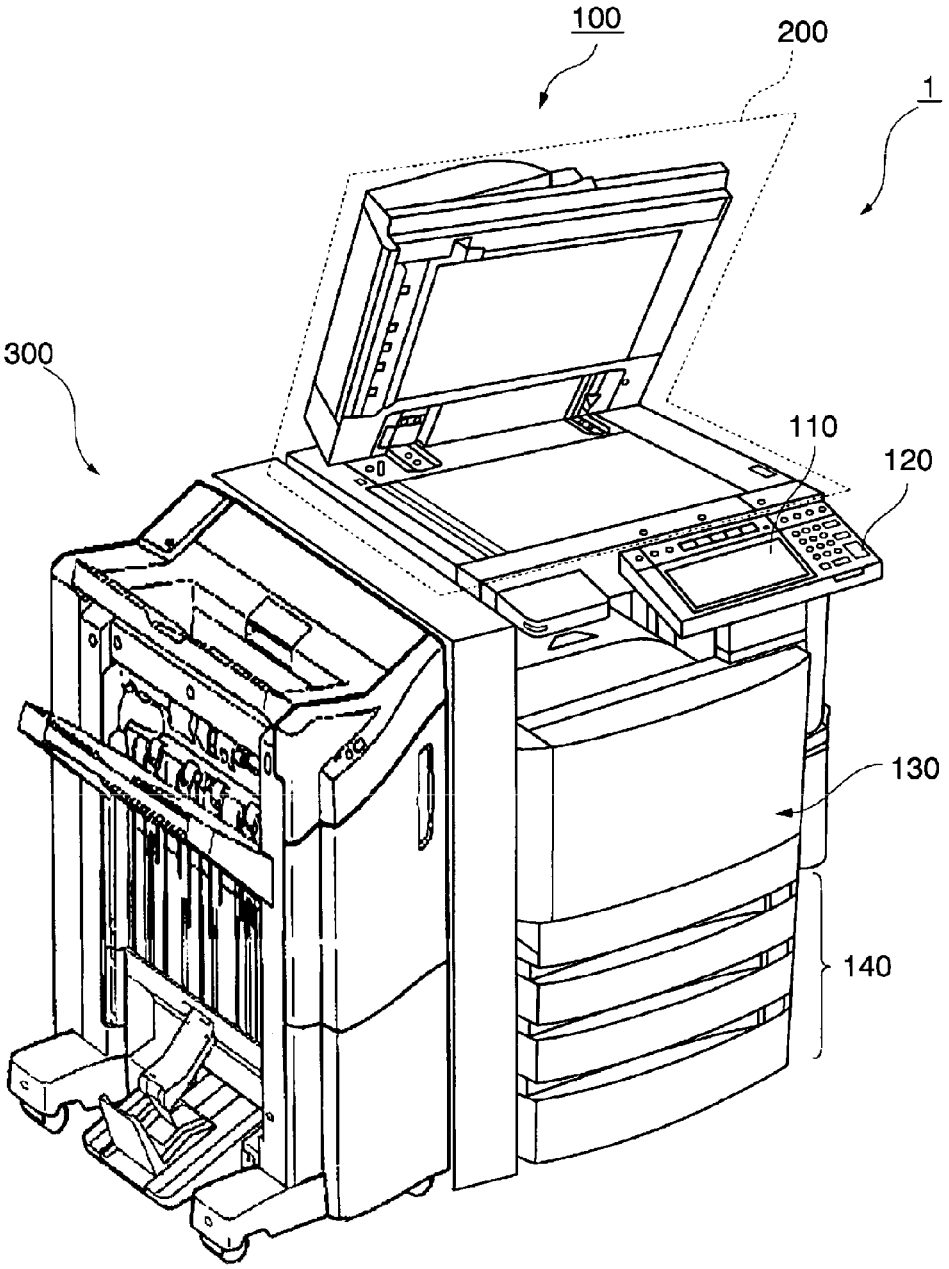
FIG. 1 is an external view illustrating an overall configuration example of an image forming system of an embodiment.

FIG. 1 is an external view illustrating an overall configuration example of an image forming system 1 of the embodiment. The image forming system 1 includes an image forming apparatus 100 and a post-processing apparatus 300. The image forming apparatus 100 is, for example, a multi-function peripheral having a copy function and other functions. The image forming apparatus 100 includes a display 110, a control panel 120, a printer unit 130, a sheet storage unit 140, and an image reading unit 200. The image forming apparatus 100 forms an image on a sheet using a developer such as toner. The sheet is, for example, a sheet-like material such as a paper or label paper. Any sheet-like recording medium can be used as long as the image forming apparatus 100 can form an image on a surface thereof.

Figure 2:
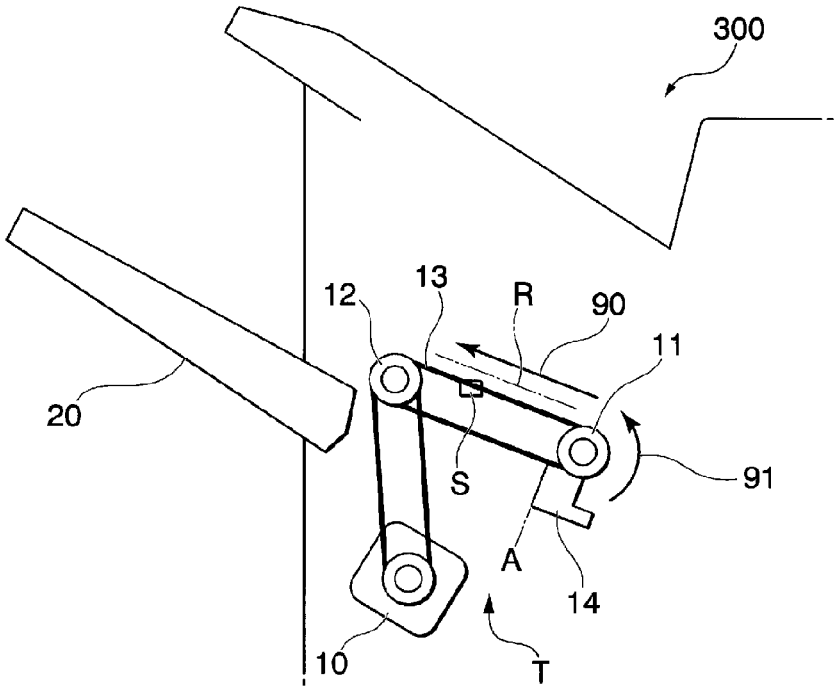
FIG. 2 is a view illustrating a configuration of a processing tray of a post-processing apparatus.
Figure 3:
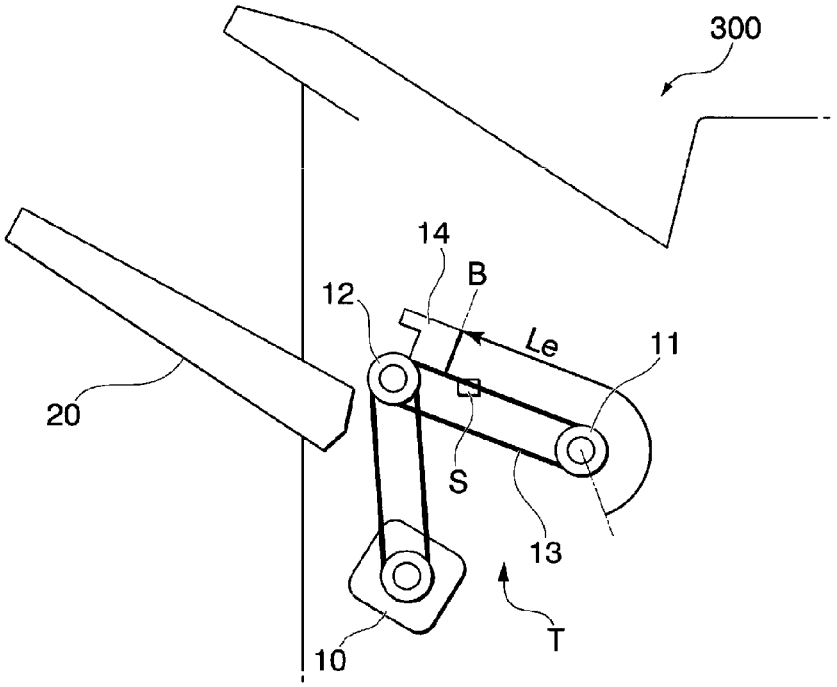
FIG. 3 is a view illustrating a configuration of the processing tray of the post-processing apparatus.

The post-processing apparatus 300 is communicably connected to the image forming apparatus 100. The post-processing apparatus 300 is an apparatus that performs post-processing on a sheet on which an image may be formed by the image forming apparatus 100. Specific examples of post-processing performed by the post-processing apparatus 300 include sort processing, hole-punching processing, staple processing, bookbinding processing, and the like. FIGS. 2 and 3 are views illustrating a configuration of a processing tray T of the post-processing apparatus 300 of the embodiment. In FIG. 2, the image forming apparatus 100 is disposed on a right side of the post-processing apparatus 300, when viewing the image forming system 1 from the front.

The post-processing apparatus 300 includes a driving unit 10, the processing tray T, and a discharge tray 20. The processing tray T includes a mechanism that discharges a sheet bundle that is post-processed in the post-processing apparatus 300. The processing tray T includes a first transport roller 11, a second transport roller 12, a discharge belt 13, a bundle hook 14, and a sheet detection sensor S. The post-processing apparatus 300 further includes devices (not illustrated) which perform hole-punching processing, stapling processing, and bookbinding processing. Next, a configuration of the processing tray T will be described.

The first transport roller 11 and the second transport roller 12 are cylindrical rollers. The first transport roller 11 and the second transport roller 12 are disposed such that rotational axes thereof are in parallel. The discharge belt 13 is wound around the first transport roller 11 and the second transport roller 12. The bundle hook 14 protruding toward the outer periphery of the discharge belt 13 is provided on a part of a surface of the discharge belt 13. The bundle hook 14 is formed in a hook shape to discharge the sheet bundle including a sheet or a plurality of sheets. The bundle hook 14 moves and discharges the sheet bundle or the like onto the discharge tray 20 in accordance with the rotational movement of the discharge belt 13 rotated by the first transport roller 11 and the second transport roller 12.

The driving unit 10 is a driving device such as a motor. The driving unit 10 is a driving source of the processing tray T provided in the post-processing apparatus 300. The driving unit 10 rotates, for example, the second transport roller 12. The rotation generated by the driving unit 10 drives the second transport roller 12 via, for example, a driving belt (not illustrated). Moreover, it is not necessary for the post-processing apparatus 300 to have one driving unit 10. The post-processing apparatus 300 may have a plurality of driving units 10, and the driving unit 10 may directly drive the first transport roller 11 or the second transport roller 12.

The first transport roller 11 is disposed to be separated and parallel to the second transport roller 12, and tensions the discharge belt 13. The second transport roller 12 is a driving roller that is driven by the driving unit 10 to rotate. The first transport roller 11 is a driven roller that rotates in conjunction with the rotation of the discharge belt 13. The first transport roller 11 is rotated to apply a force to a discharged sheet in a direction (hereinafter, referred to as "discharge direction") toward the discharge tray 20 (see FIG. 4).

As described above, the second transport roller 12 is rotated to drive the discharge belt 13, and then the first transport roller 11 rotates in conjunction with the movement of the discharge belt 13. That is, the first transport roller 11 rotates in conjunction with the rotation of the second transport roller 12, as a result. The first transport roller 11 and the second transport roller 12 rotate at the same peripheral speed by the discharge belt 13. The second transport roller 12 is rotated to apply a force to the discharged sheet in the discharge direction (see FIG. 4). An operation (for example, rotation) of the driving unit 10 is controlled and thereby a rotation speed of the second transport roller 12 is controlled.

The discharge belt 13 is wound around the first transport roller 11 and the second transport roller 12. The discharge belt 13 is driven by the rotation of the second transport roller 12. A pushing force is applied to the sheet bundle to be discharged by the discharge belt 13 in the discharge path R in a direction (hereinafter, referred to as "discharge direction") toward the discharge tray 20. The discharge direction is a direction that is indicated, for example, by an arrow 90 in FIG. 2.

The bundle hook 14 moves along the discharge path R through which the sheet bundle passes when the sheet bundle is discharged. The bundle hook 14 pushes out the sheet bundle in the discharge direction by moving itself. The bundle hook 14 positioned at a standby position A is illustrated in FIG. 2. The bundle hook 14 positioned at a stop position B after the discharging movement is illustrated in FIG. 3. The bundle hook 14 moves from the standby position A illustrated in FIG. 2 to the stop position B illustrated in FIG. 3 in conjunction with the movement of the discharge belt 13, thereby hooking one end of the sheet bundle and pushing out the sheet bundle in the discharge direction. Hereinafter, a specific example of the movement of the bundle hook 14 will be described.

The bundle hook 14 moves upward the discharge belt 13 from the standby position A along an arrow 91 shown in FIG. 2. Next, the bundle hook 14 moves in the discharge direction along the discharge path R shown in FIG. 2. The bundle hook 14 moves toward the stop position B and stops at the stop position B as shown in FIG. 3. For example, in a state where the bundle hook 14 stands by at the standby position A, the sheet bundle is placed on an upper surface side of the discharge belt 13. Thereafter, the bundle hook 14 hooks one end of the sheet bundle as the discharge belt 13 moves. By moving the bundle hook 14 in the discharge direction, the sheet bundle is discharged from the other end side onto the discharge tray 20.

The sheet detection sensor S detects presence or absence of the sheet bundle in the discharge path R. Specifically, the sheet detection sensor S is provided at a position at which the sheet bundle on the upper surface side of the discharge belt 13 is capable of being detected by the sheet detection sensor S. For example, the sheet detection sensor S is provided apart from one side of the discharge belt 13 (see FIG. 4). For example, an upper end of the sheet detection sensor S protrudes in an upward direction from an upper surface position of the discharge belt 13. For the sheet detection sensor S, for example, an actuator that outputs an output value with respect to (e.g., proportional to) displacement is used.

Therefore, if the sheet bundle is placed on the upper surface of the discharge belt 13, the sheet bundle is detected by the sheet detection sensor S. Based on the displacement of the actuator of the sheet detection sensor S because of the weight of the sheet bundle, the sheet detection sensor S outputs the output value. After the sheet bundle is discharged, the sheet detection sensor S does not output the output value because the displacement of the actuator becomes zero. The type of the sheet detection sensor S and the position of the sheet detection sensor S are not limited to the example described above, and another type of sensor may be used as long as the sheet bundle placed on the discharge belt 13 can be detected, and the sheet detection sensor S may be disposed at another position. The sheet detection sensor S is connected to a determination unit 42 that determines the presence or absence of the sheet bundle based on an output value which is described later.

The discharge tray 20 is a tray to receive the sheet bundle discharged to the outside of the processing tray T by the bundle hook 14. The discharged sheet bundle is placed on the discharge tray 20.

Figure 4:
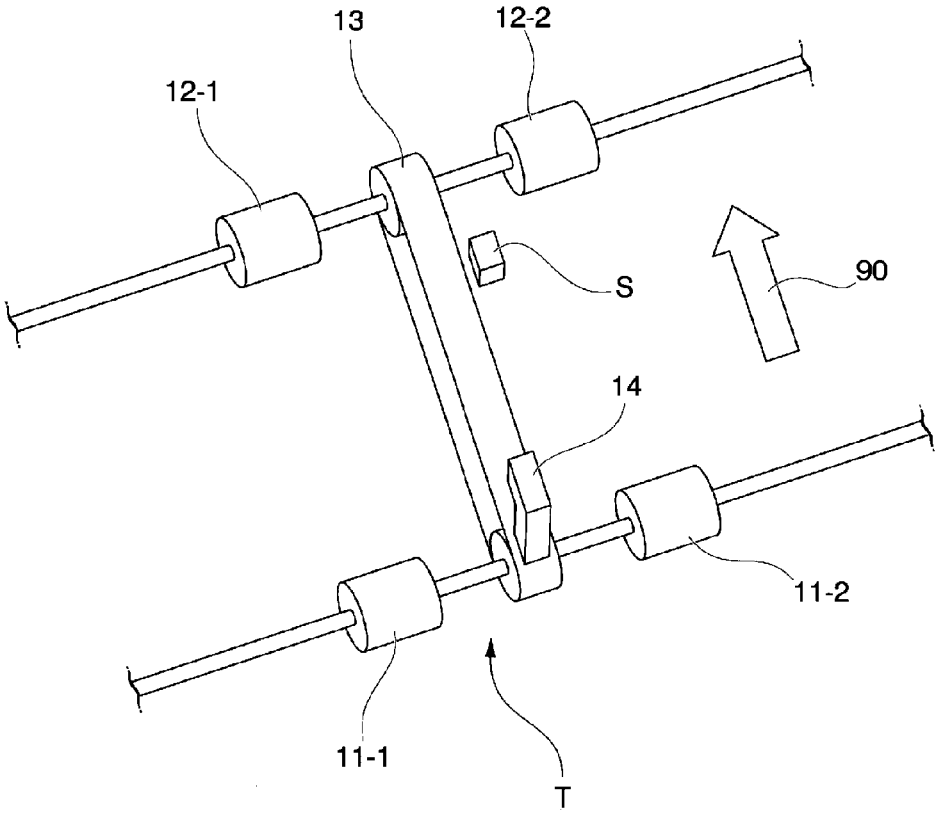
FIG. 4 is a view illustrating a specific example of the processing tray.

FIG. 4 is a view illustrating a specific example of the processing tray T. For example, two first transport rollers 11 and two second transport rollers 12 may be provided. As illustrated in FIG. 4, a first left transport roller 11-1, a first right transport roller 11-2, a second left transport roller 12-1, and a second right transport roller 12-2 may be provided. In addition, the bundle hook 14 may be provided on the discharge belt 13 moving along the discharge direction (direction indicated by the arrow 91). In this case, the bundle hook 14 moves as the discharge belt 13 rotates.

Figure 5:
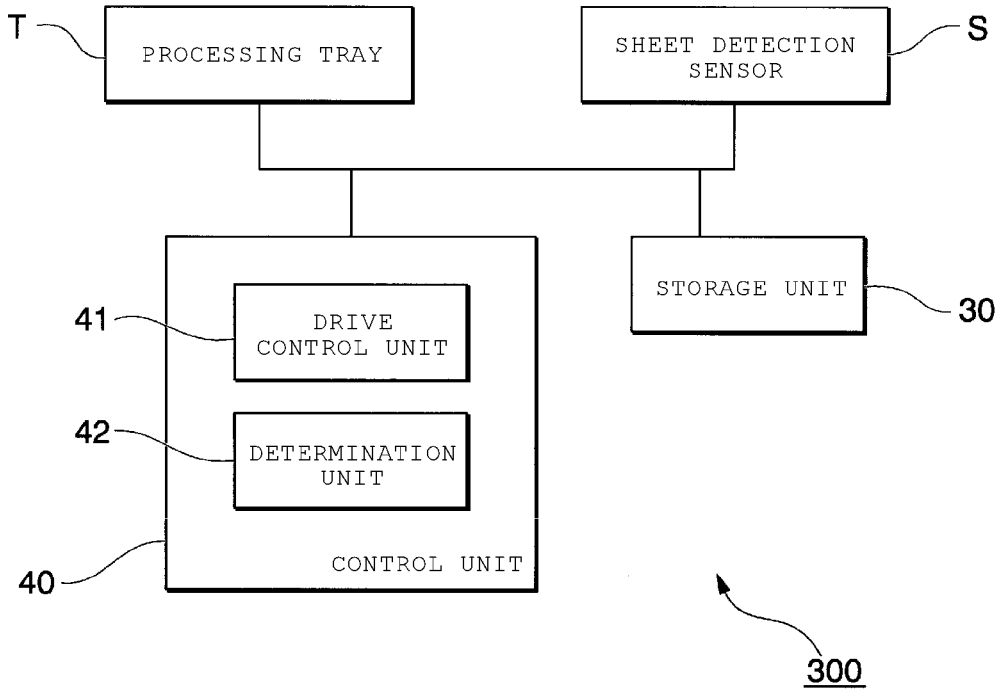
FIG. 5 is a block diagram illustrating a functional configuration of the post-processing apparatus.

FIG. 5 is a block diagram illustrating a functional configuration of the post-processing apparatus 300. The post-processing apparatus 300 includes the processing tray T, the sheet detection sensor S, a storage unit 30, and a control unit 40.

The storage unit 30 is a storage device such as a cache or a memory. The storage unit 30 stores an output value output from the sheet detection sensor S, a request to discharge the sheet bundle which is described later, or the like. The storage unit 30 further stores parameters to control the driving unit 10 by the control unit 40. Specific examples of the parameters stored in the storage unit 30 include a rotation speed, a rotation time, the rotation speed of a motor of the driving unit 10, and the like.

The control unit 40 includes a drive control unit 41 that controls the driving unit 10 and the determination unit 42 that determines the output value of the sheet detection sensor S. In one embodiment, the control unit 40 is a CPU that is programmed to function as the drive control unit 41 and the determination unit 42. In addition, a part of or an entirety of the control unit 40 may be implemented in hardware such as Large Scale Integration (LSI), Application Specific Integrated Circuit (ASIC), and Field-Programmable Gate Array (FPGA).

The control unit 40 determines whether or not a last sheet bundle that is lastly discharged is processed in processing of the plurality of sheet bundles based on an instruction from the image forming apparatus 100. In addition, the control unit 40 determines whether or not a request to discharge the sheet bundle is "ON" with reference to the storage unit 30 when starting the next post-processing.

The drive control unit 41 controls the operation of the driving unit 10. The drive control unit 41 controls the driving unit 10, for example, when the post-processing apparatus 300 discharges the sheet. The drive control unit 41 performs discharge control of the sheet bundle if the request to discharge the sheet bundle is "ON" when post-processing is started.

The determination unit 42 determines whether or not the sheet bundle is in the discharge path R based on the output value of the sheet detection sensor S. That is, the determination unit 42 determines whether or not the sheet bundle is placed on the processing tray T. In addition, after the sheet bundle is discharged, the determination unit 42 determines whether or not outputting of error signal should be performed based on whether or not the sheet detection sensor S detects that there is the sheet bundle on the discharge belt 13. The error means, for example, a trouble occurred in the post-processing apparatus 300 such as jamming of the sheet bundle. The determination unit 42 performs the outputting of the error signal and thereby a message such as paper jam is displayed on the display 110.

In addition, the determination unit 42 determines whether or not there is a sheet bundle placed on the processing tray T after the discharge of the last sheet bundle. The determination unit 42 does not perform the error output even if it determines that there is a sheet bundle on the processing tray T after the discharge of the last sheet bundle has been carried out. Instead, the determination unit 42 turns on a request flag to discharge the sheet bundle during the next post-processing job. The information indicating a state of the request flag is temporarily stored in the storage unit 30.

At times, a user takes out the last sheet bundle during the discharge of the last sheet bundle. While the user is taking out the last sheet bundle, if a rear end of the last sheet bundle comes in contact with the sheet detection sensor S, the sheet detection sensor S may mistakenly detect there is the sheet bundle on the discharge belt 13.

In such a case, the determination unit 42 may erroneously determine that there is a sheet bundle on the discharge belt 13 and erroneously perform the error output based on the detection of the sheet detection sensor S caused by the user's operation even though the last sheet bundle is not actually on the discharge belt 13. Therefore, in the post-processing apparatus 300 according to embodiments, the determination unit 42 sets a request flag to perform discharge processing of a sheet bundle before starting the next post-processing job so as to prevent triggering an error unnecessarily.

Figure 6:
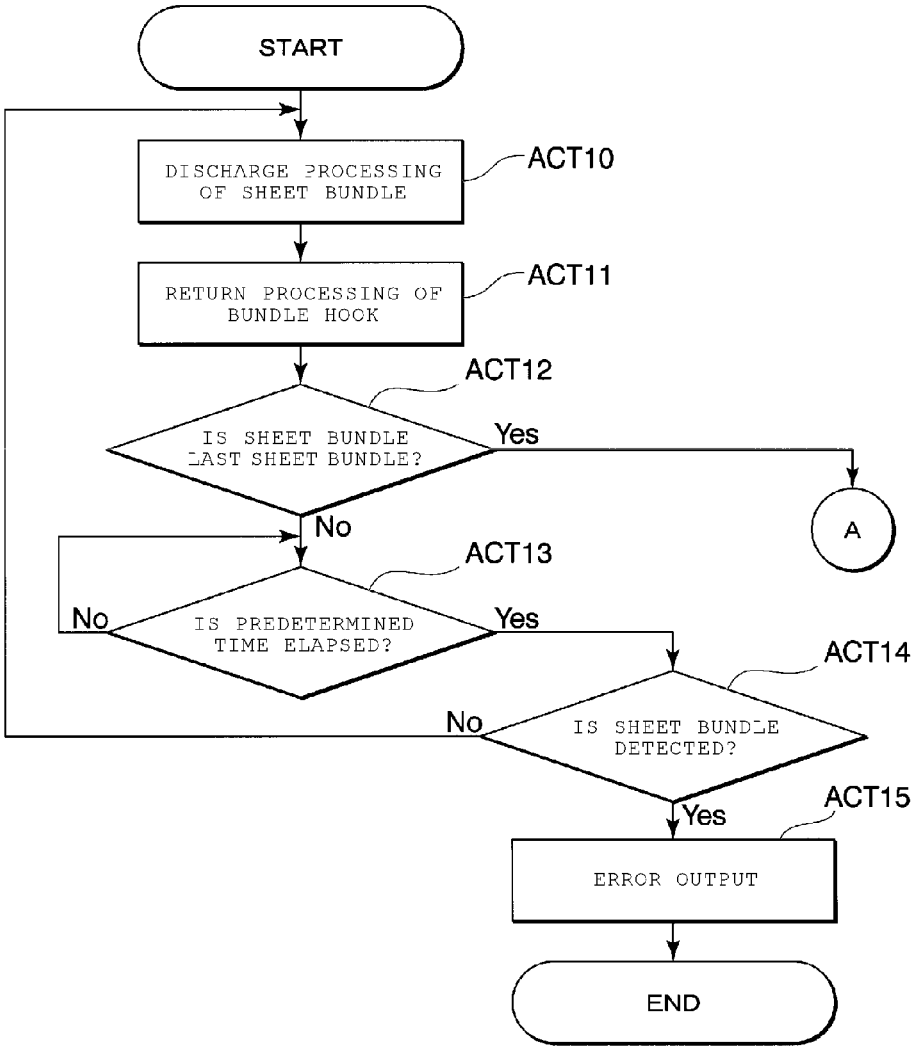
FIG. 6 is a flowchart illustrating processing of discharging a plurality of sheet bundles in the post-processing apparatus.
Figure 7:
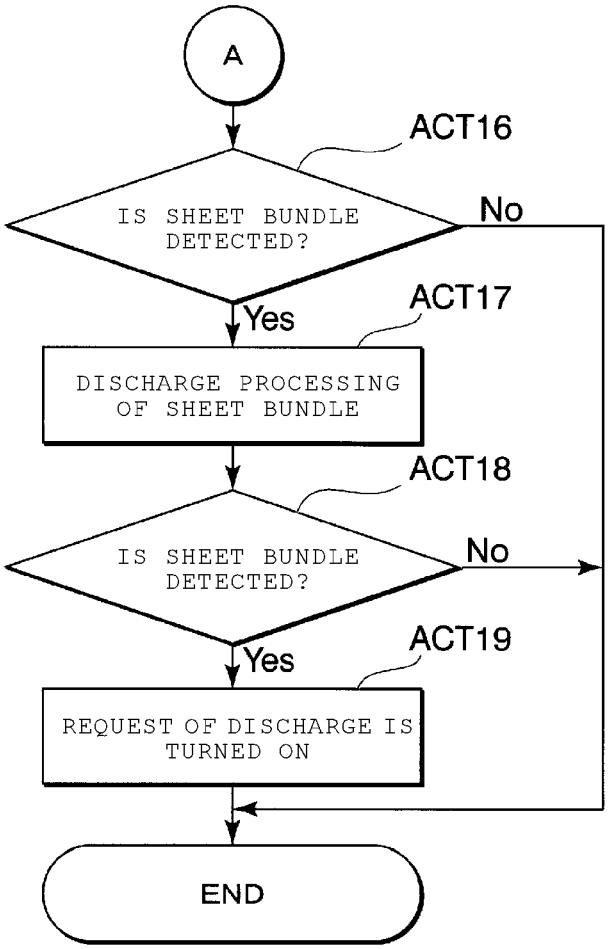
FIG. 7 is a flowchart illustrating processing of discharging the plurality of sheet bundles in the post-processing apparatus.
Figure 8:
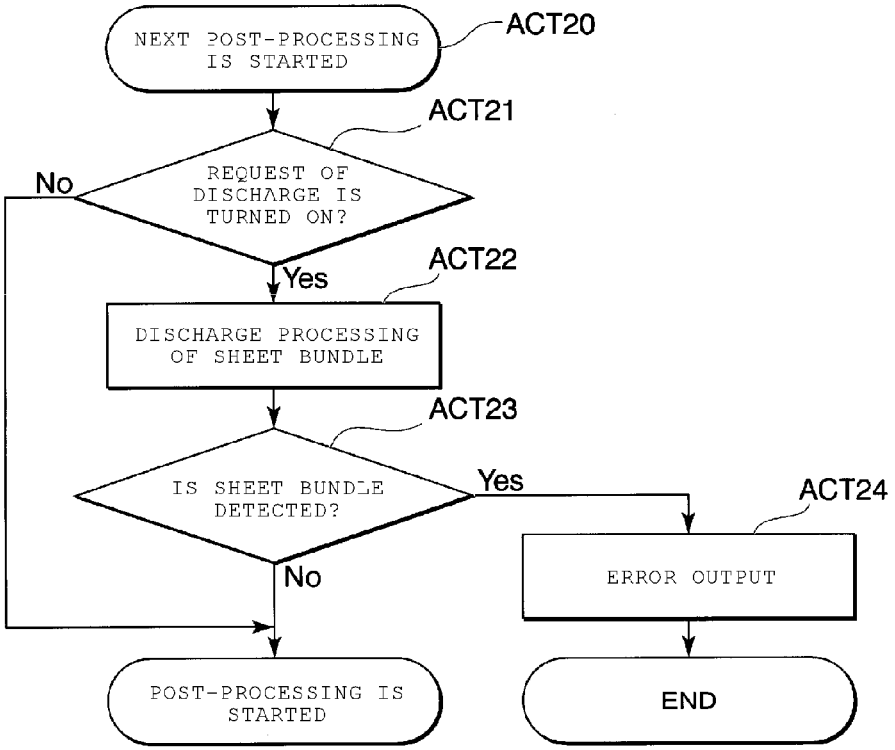
FIG. 8 is a flowchart illustrating processing of discharging the plurality of sheet bundles in the post-processing apparatus.

Hereinafter, details of processing of the post-processing apparatus 300 will be described in detail. FIGS. 6 to 8 are flowcharts illustrating processing of discharging the plurality of sheet bundles in the post-processing apparatus 300. In a series of flow for post-processing the plurality of sheet bundles, a part of the sheet bundles to be post-processed is placed on the processing tray T. Thereafter, the drive control unit 41 drives and controls the driving unit 10 to move the bundle hook 14 from the standby position A to the stop position B, and performs processing for discharging the sheet bundle (ACT 10). After discharge processing, the drive control unit 41 drives and controls the driving unit 10 to move the bundle hook 14 from the stop position B to the standby position A, and performs return processing of the bundle hook 14 (ACT 11).

In ACT 12, the control unit 40 determines whether or not a sheet bundle on the discharge belt 13 is a last sheet bundle of a current post-processing job. If the sheet bundle is not the last sheet bundle (ACT 12: No), the control unit 40 determines whether or not a predetermined time is elapsed from return processing (ACT 13). Here, the predetermined time is, for example, 200 msec. If the predetermined time is elapsed (ACT 13: Yes), the determination unit 42 determines whether or not there is a sheet bundle placed on the processing tray T (ACT 14). Here, the determination unit 42 performs detection determination of the sheet bundle based on an output of the sheet detection sensor S.

If the determination unit 42 determines there is no sheet bundle placed on the processing tray T (ACT 14: No), the procedure returns to ACT 11 and discharge processing of the sheet bundle is continued. If the determination unit 42 determines there is the sheet bundle placed on the processing tray T (ACT 14: Yes), the determination unit 42 performs the error output (ACT 15). According to the processing described above, the post-processing apparatus 300 can perform discharge processing of the plurality of sheet bundles to the last sheet bundle.

Next, processing of a case where it is determined that the sheet bundle is the last sheet bundle by the control unit 40 (ACT 12: Yes) will be described. As illustrated in FIG. 7, the determination unit 42 determines whether or not there is a sheet bundle placed on the processing tray T (ACT 16). If it is determined that there is the sheet bundle (ACT 16: Yes), the drive control unit 41 performs discharge processing of the sheet bundle by driving and controlling the driving unit (ACT 17). Discharge processing of the sheet bundle is similar to the operations in ACT 10 and ACT 11. Thereafter, the determination unit 42 determines whether or not there is the sheet bundle placed on the processing tray T (ACT 18).

If it is determined that there is the sheet bundle, the determination unit 42 turns on the request flag to discharge the sheet bundle when starting another post-processing that is performed next time (ACT 19). Thereafter, the post-processing apparatus 300 ends the processing. In ACT 18, if the sheet bundle is not detected (ACT 16: No), the post-processing apparatus 300 ends the processing.

Consequently, a post-processing job including a series of post-processing of the plurality of sheet bundles by the post-processing apparatus 300, is ended. Hereinafter, the start of the next post-processing job will be described.

As illustrated in FIG. 8, the control unit 40 determines whether or not the request to discharge the sheet bundle is turned on with reference to the storage unit 30 when starting the next post-processing (ACT 21). The drive control unit 41 performs a discharge operation for discharging the sheet bundle by controlling the driving unit 10 if the request is turned on (ACT 22). Thereafter, the determination unit 42 determines whether or not there is the sheet bundle placed on the processing tray T (ACT 23). If the determination unit 42 determines that there is no sheet bundle placed on the processing tray T (ACT 23: No), post-processing of the sheet bundle that is performed in the next is started.

If the determination unit 42 determines that there is the sheet bundle placed on the processing tray T (ACT 23: Yes), the determination unit 42 performs the error output (ACT 24). Thereafter, the post-processing apparatus 300 ends the processing. As described above, in the post-processing apparatus 300, the determination unit 42 does not perform the error output if the output of the sheet detection sensor S is detected after the last sheet bundle is discharged.

The processing described above is an example, the processing from ACT 20 to ACT 24 may be provided before ACT in the post-processing apparatus 300. That is, the post-processing apparatus 300 may perform discharge processing of the sheet bundle based on the request to discharge the sheet bundle of a previous post-processing job before the start of the current post-processing job.

According to at least one embodiment described above, it is possible to reduce the occurrence frequency of erroneous determinations of sheet jamming, by providing the processing tray T, the sheet detection sensor S, and the determination unit 42. In the post-processing apparatus 300, the user takes out the last sheet bundle during discharging the last sheet bundle and thereby it is possible to reduce the occurrence frequency of erroneous outputting of the error message.

Even if the sheet bundle is detected in ACT 18, the post-processing apparatus 300 issues the request to perform discharge processing during the next post-processing job without outputting the error message in ACT 19. Therefore, in the post-processing apparatus 300, post-processing of the sheet bundle can be ended without an unnecessary error determination.

In the post-processing apparatus 300, detecting processing of the sheet bundle is performed after discharge processing of the sheet bundle based on the request when starting the next post-processing. Therefore, in the post-processing apparatus 300, it is possible to cancel the erroneous detection result of the sheet detection sensor S caused by a user while the user is taking out the last sheet bundle.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A post-processing apparatus for an image forming apparatus, the apparatus comprising:

a processing tray on which a sheet bundle is placed for discharging onto a discharge tray;

a detector configured to detect presence or absence of the sheet bundle on the processing tray; and a controller configured to control driving of the processing tray to discharge the sheet bundle onto the discharge tray and to determine whether or not to output an error if a detection result of the detector after the processing tray has been driven to discharge the sheet bundle onto the discharge tray indicates presence of the sheet bundle, wherein the controller outputs the error if the sheet bundle is not a last sheet bundle of a post-processing job and does not output the error if the sheet bundle is the last sheet bundle of the post-processing job.

2. The post-processing apparatus according to claim 1, wherein the controller drives the processing tray to discharge the sheet bundle onto the discharge tray prior to a next post-processing job if the sheet bundle is the last sheet bundle of a current post-processing job.

3. The post-processing apparatus according to claim 2, wherein the controller sets a flag if the detection result of the detector after the processing tray has been driven to discharge the sheet bundle onto the discharge tray indicates presence of the sheet bundle and the sheet bundle is the last sheet bundle of a current post-processing job, and reads the flag prior to starting the next post-processing job.

4. The post-processing apparatus according to claim 1, wherein the processing tray includes:

a movable belt configured to support the sheet bundle thereon, and a discharge hook that moves with the belt as the belt is driven under control of the controller, to discharge the sheet bundle onto the discharge tray.

5. The post-processing apparatus according to claim 4, wherein the detector comprises a sensor positioned near the movable belt to detect the presence or the absence of the sheet bundle on the movable belt.

6. The post-processing apparatus according to claim 5, wherein the sensor outputs a signal indicating the presence or the absence of the sheet bundle on the movable belt to the controller.

7. An image forming apparatus including a post-processing apparatus, the post-processing apparatus comprising:

a processing tray on which a sheet bundle is placed for discharging onto a discharge tray;

a detector configured to detect presence or absence of the sheet bundle on the processing tray; and a controller configured to control driving of the processing tray to discharge the sheet bundle onto the discharge tray and to determine whether or not to output an error if a detection result of the detector after the processing tray has been driven to discharge the sheet bundle onto the discharge tray indicates presence of the sheet bundle, wherein the controller outputs the error if the sheet bundle is not a last sheet bundle of a post-processing job and does not output the error if the sheet bundle is the last sheet bundle of the post-processing job.

8. The image forming apparatus according to claim 7, wherein the controller drives the processing tray to discharge the sheet bundle onto the discharge tray prior to a next post-processing job if the sheet bundle is the last sheet bundle of a current post-processing job.

9. The image forming apparatus according to claim 8, wherein the controller sets a flag if the detection result of the detector after the processing tray has been driven to discharge the sheet bundle onto the discharge tray indicates presence of the sheet bundle and the sheet bundle is the last sheet bundle of a current post-processing job, and reads the flag prior to starting the next post-processing job.

10. The image forming apparatus according to claim 7, wherein the processing tray includes:

a movable belt configured to support the sheet bundle thereon, and a discharge hook that moves with the belt as the belt is driven under control of the controller, to discharge the sheet bundle onto the discharge tray.

11. The image forming apparatus according to claim 10, wherein the detector comprises a sensor positioned near the movable belt to detect the presence or the absence of the sheet bundle on the movable belt.

12. The image forming apparatus according to claim 11, wherein the sensor outputs a signal indicating the presence or the absence of the sheet bundle on the movable belt to the controller.

13. A sheet post-processing method comprising:

executing a post-processing job including a plurality of sheet bundles;

performing discharging of the sheet bundles of the first post-processing job one at a time via a discharge path;

detecting presence or absence of the sheet bundle in the discharge path;

determining whether or not to output an error if a detection result after performing the discharging indicates presence of the sheet bundle; and outputting the error if the sheet bundle is not a last sheet bundle of the post-processing job, and not outputting the error if the sheet bundle is the last sheet bundle of the post-processing job.

14. The method according to claim 13, further comprising:

prior to starting a next post-processing job, performing discharging of the sheet bundle via the discharge path if the sheet bundle is the last sheet bundle of the current post-processing job.

15. The method according to claim 14, further comprising:

setting a flag if the detection result after performing the discharging indicates presence of the sheet bundle and the sheet bundle is the last sheet bundle of the current post-processing job; and reading the flag prior to starting the next post-processing job.

16. The method according to claim 13, wherein the discharging is performed using a processing tray that includes:

a movable belt configured to support the sheet bundle thereon, and a discharge hook that moves with the belt as the belt is driven under control of the controller, to discharge the sheet bundle onto the discharge tray.

17. The method according to claim 16, wherein the detecting is performed by a sensor that is positioned near the movable belt to detect the presence or the absence of the sheet bundle on the movable belt.

18. The method according to claim 17, wherein the sensor outputs a signal indicating the presence or the absence of the sheet bundle on the movable belt to a controller that determines whether or not to output the error.

* * * * *